US009089897B2

(12) United States Patent
Rhee et al.

(10) Patent No.: US 9,089,897 B2
(45) Date of Patent: Jul. 28, 2015

(54) METHOD OF MANUFACTURING NANOPARTICLES USING ION EXCHANGE RESIN AND LIQUID REDUCING PROCESS

(71) Applicant: SOONCHUNHYANG UNIVERSITY INDUSTRY ACADEMY COOPERATION FOUNDATION, Asan-si, Chungcheongnam-do (KR)

(72) Inventors: In Hyoung Rhee, Seoul (KR); Hyun Jun Jung, Suwon-si (KR)

(73) Assignee: SOONCHUNYANG UNIVERSITY INDUSTRY ACADEMY COOPERATION FOUNDATION, Chungcheongnam-Do (KR)

( * ) Notice: Subject to any disclaimer, the term of this patent is extended or adjusted under 35 U.S.C. 154(b) by 117 days.

(21) Appl. No.: 14/051,426

(22) Filed: Oct. 10, 2013

(65) Prior Publication Data

US 2015/0082946 A1 Mar. 26, 2015

(30) Foreign Application Priority Data

Sep. 23, 2013 (KR) ..... 10-2013-0112515

(51) Int. Cl.

| | |
|---|---|
| ***C22B 3/20*** | (2006.01) |
| ***C22B 3/00*** | (2006.01) |
| ***B22F 9/24*** | (2006.01) |

(Continued)

(52) U.S. Cl.

CPC ..... *B22F 9/24* (2013.01); *C22B 3/0098* (2013.01); *C22B 5/00* (2013.01); *C22C 5/04* (2013.01); *B22F 1/0018* (2013.01); *B22F 2301/25* (2013.01); *B22F 2304/05* (2013.01)

(58) Field of Classification Search

CPC ..... C22B 3/20; C22B 3/0098; C22B 5/00; B22F 9/24; B22F 2301/25; B22F 2304/05

See application file for complete search history.

(56) References Cited

U.S. PATENT DOCUMENTS

| | | | | |
|---|---|---|---|---|
| 8,388,870 | B2 | 3/2013 | Sano et al. | |
| 2009/0039019 | A1 * | 2/2009 | Raman | 210/638 |

(Continued)

FOREIGN PATENT DOCUMENTS

| | | | | |
|---|---|---|---|---|
| CN | 1903430 | A * | 1/2007 | |
| JP | 2003082475 | A * | 3/2003 | C23C 26/00 |

(Continued)

OTHER PUBLICATIONS

Wen Hongliang et al. "Method for Preparing Nickel Nanometer Catalyst." Patent CN 1903430 A. Jan. 31, 2007. Machine translation.*

(Continued)

*Primary Examiner* — George Wyszomierski
*Assistant Examiner* — Tima M McGuthry Banks
(74) *Attorney, Agent, or Firm* — Revolution IP, PLLC

(57) ABSTRACT

Provided is a method of manufacturing nanoparticles using an ion exchange resin and a liquid reducing process. The method includes (a) capturing a nanoparticle precursor from a solution in which impurities are mixed using an ion exchange resin, (b) washing and layer-separating the breakthrough ion exchange resin, (c) separating only the ion exchange resin in which the nanoparticle precursor is captured from the layer-separated ion exchange resin, and (d) putting the separated ion exchange resin into a mixture solution in which a reducing agent and a dispersing agent are mixed.

7 Claims, 3 Drawing Sheets

(51) Int. Cl.

| | |
|---|---|
| ***C22C 5/04*** | (2006.01) |
| ***C22B 5/00*** | (2006.01) |
| *B22F 1/00* | (2006.01) |

(56) References Cited

U.S. PATENT DOCUMENTS

| | | | | |
|---|---|---|---|---|
| 2010/0041775 | A1 | 2/2010 | Waki | |
| 2012/0329935 | A1 * | 12/2012 | Matsumura et al. | 524/434 |

FOREIGN PATENT DOCUMENTS

| | | | |
|---|---|---|---|
| KR | 10-2010-0021364 | A | 2/2010 |
| KR | 10-2012-0098599 | A | 9/2012 |

OTHER PUBLICATIONS

Otsuka, K et al. "Method for Manufacturing Fine Particle Dispersion". Patent JP 2003082475 A. Mar. 19, 2003. Machine translation.*

* cited by examiner

-Prior Art-

METHOD OF MANUFACTURING NANOPARTICLES USING ION EXCHANGE RESIN AND LIQUID REDUCING PROCESS

CROSS-REFERENCE TO RELATED APPLICATION

This application claims priority to and the benefit of Korean Patent Application No. 10-2013-0112515, filed Sep. 23, 2013, the disclosure of which is incorporated herein by reference in its entirety.

BACKGROUND

1. Field of the Invention

The present invention relates to a method of manufacturing nanoparticles using an ion exchange resin and a liquid reducing process, and particularly, to a method of manufacturing nanoparticles using an ion exchange resin and a liquid reducing process, which includes capturing a nanoparticle precursor from a solution in which impurities are mixed using an ion exchange resin, and separating and putting the ion exchange resin into a mixture solution including a reducing agent and a dispersing agent, to manufacture high purity, uniform, and stable nanoparticles through removal of impurities and control of a reaction.

2. Discussion of Related Art

As one of nanotechnologies attracting great attention today, a method of manufacturing nanoparticles is a high-end field which is attempted to be researched by many countries including developed countries to be applied in magnetic recording media, printer ink toners, medical diagnosis reagents, antistatic agents, electromagnetic interference shielders and absorbers, etc. Particularly, iron oxide nanoparticles having a monodispersed particle size can be used in preparation of a complex in combination with a conductive polymer, or used as a basic material used in an electronic, medical, or electrical field since they can be applied as a magnetic recording medium, a printer ink toner, a medical diagnosis reagent, an antistatic agent, an electromagnetic interference shielder and absorber, etc. using superparamagnetism due to monodispersed particles. Generally, magnetic particles have various characteristics of a magnetic material according to manufacturing conditions or a manufactured particle size. Moreover, iron oxide nanoparticles having monodispersity exhibit superparamagnetism having a single magnetic domain and high magnetic susceptibility.

In addition, nanotechnology is technology of adjusting and controlling materials in an atomic or molecular level, and is applied in various industries due to unique characteristics of a nanoscale material. Research on such nanotechnology is actively progressing to manufacture a nanoscale material, control a size of the material, and develop nanomaterials having various activities. Among the technology of manufacturing nanoparticles, a liquid reducing process is frequently used, which is sufficiently recognized by those of ordinary skill in the art.

According to a conventional liquid reducing process, nanoparticles can be simply manufactured, but it is impossible to produce a uniform crystal nucleus, it is not easy to adjust a particle size, a yield is low, and impurities produced from a metal precursor and a base ion are produced.

SUMMARY OF THE INVENTION

The present invention is directed to providing a method of manufacturing nanoparticles using an ion exchange resin and a liquid reducing process to produce a uniform crystal nucleus, to adjust an optimum particle size, and to obtain a high yield.

The present invention is also directed to providing a method of manufacturing nanoparticles using an ion exchange resin and a liquid reducing process to manufacture high purity, uniform, and stable nanoparticles through removal of impurities and control of a reaction.

One aspect of the present invention provides a method of manufacturing nanoparticles using an ion exchange resin and a liquid reducing process, which includes (a) capturing a nanoparticle precursor from a solution in which impurities are mixed using an ion exchange resin; (b) washing and layer-separating the breakthrough ion exchange resin; (c) separating only the ion exchange resin in which the nanoparticle precursor is capture from the layer-separated ion exchange resin; and (d) putting the separated ion exchange resin into a mixture solution in which a reducing agent and a dispersing agent are mixed.

The nanoparticle precursor is an organic or inorganic salt of a metal, or a complex having an organic or inorganic ligand.

The complex having an organic or inorganic ligand is $Na_2Pt(OH)_4$, or a complex having a central metal selected from the group consisting of a transition metal, Zn, Cd, Al, Ga, In, Tl, Si, Ge, Sn, and Sb.

The operation (a) includes exhausting impurities from the solution in which the impurities are mixed along with the solution using an ion exchange resin to remove, and capturing a nanoparticle precursor.

The operation (b) includes, primarily, putting demineralized water in a forward direction to wash the ion exchange resin, and secondarily, back-washing the ion exchange resin using demineralized water, and air, a nitrogen ($N_2$) gas, or an argon (Ar) gas.

In the operation (d), the reducing agent is $N_2H_4$ or an organic compound having an alcohol group, and the dispersing agent is an amine-based or polymer organic compound.

The operation (d) is accompanied by stirring at a temperature of room temperature to 300° C., and at a pressure of an atmospheric pressure to 2,000 psi for a reaction of producing the nanoparticles.

BRIEF DESCRIPTION OF THE DRAWINGS

The above and other objects, features, and advantages of the present invention will become more apparent to those of ordinary skill in the art by describing in detail exemplary embodiments thereof with reference to the attached drawings, in which.

DETAILED DESCRIPTION OF EXEMPLARY EMBODIMENTS

Figure 1:
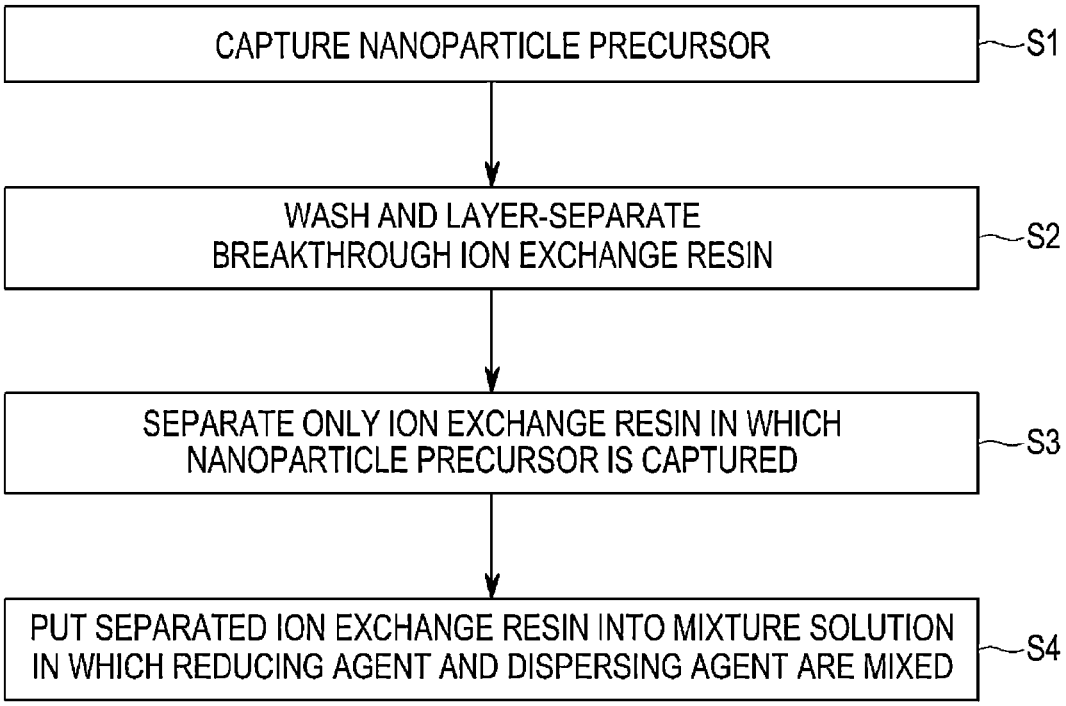
FIG. 1 is a flowchart illustrating a method of manufacturing nanoparticles using an ion exchange resin and a liquid reducing process.

Hereinafter, a method of manufacturing nanoparticles using an ion exchange resin and a liquid reducing process according to the present invention will be described in detail with reference to the accompanying drawings.

The method of manufacturing nanoparticles using an ion exchange resin and a liquid reducing process according to the present invention includes, primarily, removing unnecessary impurities through an ion exchange resin and capturing a nanoparticle precursor, separating only the ion exchange resin capturing the nanoparticle precursor, and putting the separated ion exchange resin into a mixture solution in which a reducing agent and a dispersing agent are mixed.

The process will be described in further detail below.

(a) Process of Capturing Nanoparticle Precursor (S1)

Impurities may be exhausted from a solution in which the impurities are mixed using an ion exchange resin along with the solution to remove, and only the nanoparticle precursor may be captured. The ion exchange resin may be any of a cation exchange resin or an anion exchange resin. When the nanoparticle precursor is a cation, the cation exchange resin is used, and when the nanoparticle precursor is an anion, the anion exchange resin is used.

For example, when Pt nanoparticles are manufactured from a $Na_2Pt(OH)_6$ solution, impurities such as $Li^+$, $Cl^-$, etc. are included in the $Na_2Pt(OH)_6$ solution. That is, cations and anions such as $Na^+$, $Pt(OH)_6^{2-}$, $Li^+$, $Cl^-$, etc. are mixed in the $Na_2Pt(OH)_6$ solution.

If the nanoparticle precursor is a cation, the impurities become anions, and if the nanoparticle precursor is an anion, the impurities become cations.

Here, when the $Na_2Pt(OH)_6$ solution passes through an anion exchange resin, the cations such as $Na^+$ and $Li^+$ are exhausted through the anion exchange resin with the solution, and the anions such as $Pt(OH)_6^{2-}$ and $Cl^-$ remain in the anion exchange resin.

The anion such as $Pt(OH)_6^{2-}$ is a nanoparticle precursor to manufacture nanoparticles.

(b) Process of Washing and Layer-Separating Breakthrough Ion Exchange Resin

As a process of washing an anion exchange resin in which anions such as $Pt(OH)_6^{2-}$ and $Cl^-$ remain, primarily, demineralized water is added in a forward direction to wash the anion exchange resin. Afterward, secondarily, back-washing of the anion exchange resin may be performed using demineralized water, and air, a nitrogen ($N_2$) gas, or an argon (Ar) gas.

In addition, the remaining anions are separated in the form of a layer according to a level of density (molecular weight). For example, the anions such as $Pt(OH)_6^{2-}$ and $Cl^-$ are disposed such that $Pt(OH)_6^{2-}$ having a high molecular weight is disposed under $Cl^-$ having a low molecular weight.

(c) Process of Separating Only Nanoparticle Precursor-Captured Ion Exchange Resin Accordingly, only a section of an ion exchange resin in which the anion $Pt(OH)_6^{2-}$ to be used as a nanoparticle precursor is captured may be separated from the entire ion exchange resin.

(d) Process of Putting the Separated Ion Exchange Resin into Mixture Solution in which Reducing Agent and Dispersing Agent are Mixed The separated ion exchange resin is in a state in which a nanoparticle precursor is captured. At least one or 0.001 g or more of the ion exchange resin in which such a nanoparticle precursor is captured is put into the mixture solution in which a reducing agent and a dispersing agent are mixed at regular intervals. The input time may be several to several tens of minutes. Through the reaction, in the present invention, nanoparticles may be produced.

The nanoparticle precursor may be an organic or inorganic salt of a metal, or a complex having an organic or inorganic ligand.

Here, the complex having an organic or inorganic ligand may be $Na_2Pt(OH)_4$. In addition, the complex having an organic or inorganic ligand may have a central metal selected from the group consisting of a transition metal, Zn, Cd, Al, Ga, In, Tl, Si, Ge, Sn, and Sb.

In addition, the organic or inorganic salt and ligand may be selected from molecules or ions consisting of halogen, chalcogen, and nitrogen elements such as aqua, ammine, and hydroxide.

Preferably, to obtain more pure nanoparticles, aqua or hydroxide is used as the organic or inorganic salt and ligand.

The ion exchange resin is a cation or anion exchange resin, which serves to remove impurities included in the solution and capture a nanoparticle precursor of a cation or anion.

In addition, the impurities included in the solution are all ions or salts excluding the nanoparticle precursor. Primarily, when the nanoparticle precursor is a cation, anion impurities are removed, and when the nanoparticle precursor is an anion, cation impurities are removed by an ion exchange reaction.

A layer of the ion exchange resin in which the nanoparticle precursor and ions having charges as described above are captured is separated using a density (molecular weight) difference after impurities remaining in the ion exchange resin are washed using demineralized water.

Among the ion exchange resin layers separated by the density difference, only the ion exchange resin in which the nanoparticle precursor is purely captured is separated, thereby completely removing the impurities included in the solution.

In the mixture solution, as the reducing agent, $N_2H_4$ or an organic compound having an alcohol group may be used, and as the dispersing agent, an amine-based or polymer organic compound may be used.

Preferably, to obtain more pure nanoparticles, $N_2H_4$ is used as the reducing agent.

A reaction of producing pure Pt nanoparticles is as follows.

$$N_2H_4 \rightarrow N_2 + 2H_2 + 4e^-$$

$$\underline{2R - Pt(OH)_4^{2-} + 4e^- + 4H^+ \rightarrow Pt^0 + 4H_2O}$$

$$2R - Pt(OH)_4^{2-} + N_2H_4 \rightarrow Pt^0 + N_2 + 4H_2O$$

In this reaction, R is an abbreviation of Resin, which refers to an ion exchange resin.

For this reaction in the operation of producing the nanoparticles, stirring at a temperature of room temperature to 300° C. and a pressure of an atmospheric pressure to 2,000 psi is accompanied.

In addition, as needed in this reaction, additionally, an ultrasonic generator may be used. The nanoparticles produced by the above method is a transition metal, Zn, Cd, Al, Ga, In, Tl, Si, Ge, Sn, Sb, or an oxide thereof, which has a size of 500 nm or less.

In addition, to control the reaction, at least one or 0.001 g or more of the ion exchange resin in which the nanoparticle precursor is captured may be injected into the mixture solution in which a reducing agent and a dispersing agent are mixed at regular intervals.

EXAMPLE 1

Manufacture of Pt Nanoparticles

A 10% $Na_2Pt(OH)_6$ solution was diluted to 100 ppm or less using demineralized water. The 10% $Na_2Pt(OH)_6$ solution was a solution including impurities such as $Li^+$, $Cl^-$, etc. As the first operation, the $Na_2Pt(OH)_6$ solution diluted to 100 ppm or less was injected into an anion exchange resin to capture only anions such as $Pt(OH)_6^{2-}$, $Cl^-$, etc. by an ion exchange reaction. As a second operation, the anion exchange resin in which the anions such as $Pt(OH)_6^{2-}$, $Cl^-$, etc. were captured was washed using demineralized water to remove impurities remaining in the resin layer. In addition, as a third operation, a resin layer was separated through back washing, and only an anion exchange resin in which R—$Pt(OH)_6^{2-}$ was captured was separated. As a fourth operation, 0.001 g of R—$Pt(OH)_6^{2-}$ was injected into a $N_2H_4$ solution at an interval of 1 minute. Here, Pt nanoparticles were produced by a reduction reaction, and a concentration of the $N_2H_4$ solution as the reducing agent was set to 1.2 equivalents (eq) or more, when the concentration of Pt was 1 equivalent (eq).

Figure 2:
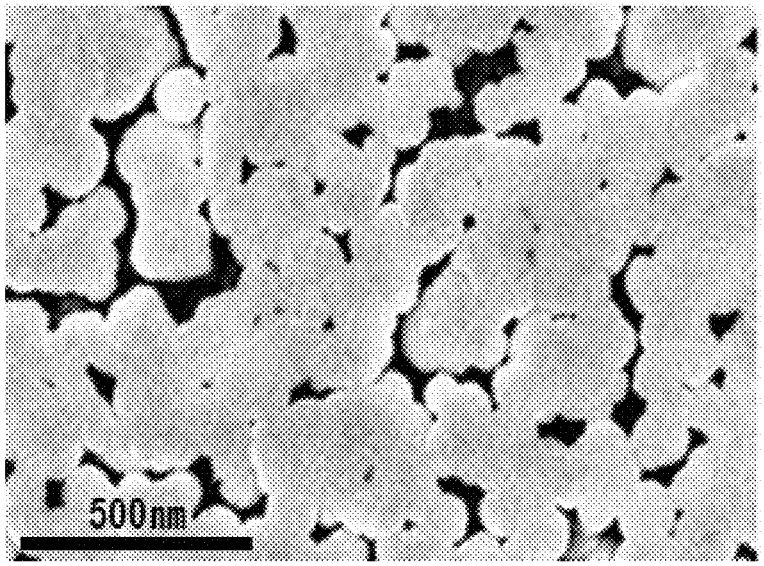
FIG. 2 is an SEM image of Pt nanoparticles manufactured according to Example of the present invention.
Figure 3:
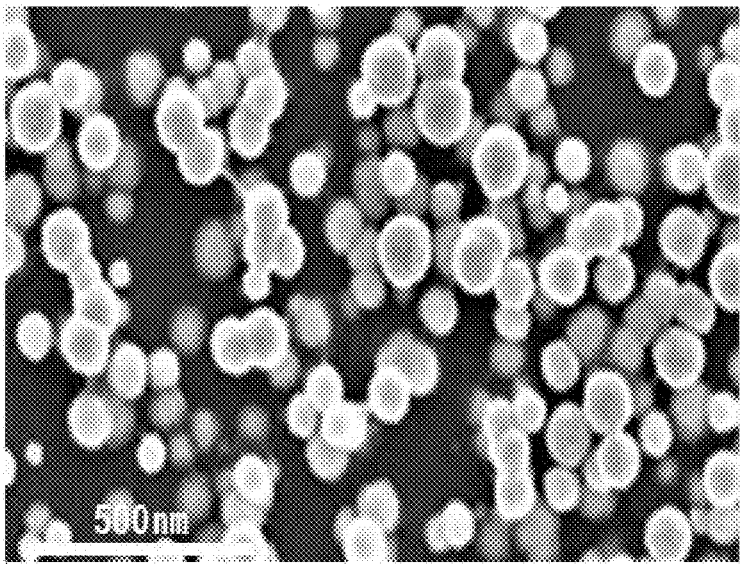
FIG. 3 is an SEM image of Pt nanoparticles manufactured according to a conventional liquid reducing process.

An SEM image of Pt nanoparticles manufactured according to Example is shown in FIG. 2. To be compared with the present invention, in FIG. 3, an SEM image of Pt nanoparticles manufactured according to a conventional liquid reducing process was shown.

According to a method of manufacturing nanoparticles using an ion exchange resin and a liquid reducing process of the present invention, a uniform crystal nucleus can be produced, a particle size can be adjusted, and high-yield nanoparticles can be simply and easily manufactured.

In addition, the manufactured nanoparticles are high purity nanoparticles from which impurities are removed, and can be applied in various industries such as chemical, environmental, material, pharmaceutical, and atomic power industries.

While the invention has been shown and described with reference to certain exemplary embodiments thereof, it will be understood by those skilled in the art that various changes in form and details may be made therein without departing from the scope of the invention as defined by the appended claims.

What is claimed is:

1. A method of manufacturing nanoparticles using an ion exchange resin and a liquid reducing process, comprising:

(a) capturing a nanoparticle precursor from a solution in which impurities are mixed using an ion exchange resin;

(b) washing and layer-separating a breakthrough ion exchange resin;

(c) separating only the ion exchange resin in which the nanoparticle precursor is captured from the layer-separated ion exchange resin; and (d) putting the separated ion exchange resin into a mixture solution in which a reducing agent and a dispersing agent are mixed.

2. The method according to claim 1, wherein the nanoparticle precursor is an organic or inorganic salt of a metal, or a complex having an organic or inorganic ligand.

3. The method according to claim 2, wherein the complex having an organic or inorganic ligand is $Na_2Pt(OH)_4$, or a complex having a central metal selected from the group consisting of a transition metal, Zn, Cd, Al, Ga, In, Tl, Si, Ge, Sn, and Sb.

4. The method according to claim 1, wherein, the operation (a) includes exhausting the impurities from the solution in which the impurities are mixed using the ion exchange resin along with the solution to remove, and capturing only a nanoparticle precursor.

5. The method according to claim 1, wherein, the operation (b) includes, primarily, washing the ion exchange resin by adding demineralized water in a forward direction, and secondarily, back-washing the ion exchange resin with demineralized water, and air, a nitrogen (N2) gas, or an argon (Ar) gas.

6. The method according to claim 1, wherein, in the operation (d), the reducing agent is $N_2H_4$ or an organic compound having an alcohol group, and the dispersing agent is an amine-based or polymer organic compound.

7. The method according to claim 1, wherein the operation (d) is accompanied by stirring performed at a temperature of room temperature to 300° C., and a pressure of an atmospheric pressure to 2,000 psi for a reaction of producing the nanoparticles.

* * * * *